US010414466B2

(12) United States Patent
Grossi

(10) Patent No.: US 10,414,466 B2
(45) Date of Patent: Sep. 17, 2019

(54) SYSTEM AND METHOD FOR THE REALIZATION OF FLOATING PLATFORMS MADE OF POST-COMPRESSED REINFORCED CONCRETE WITH FLOATING QUOTA FIXED AND INVARIABLE

(71) Applicant: Giorgio Grossi, Rome (IT)

(72) Inventor: Giorgio Grossi, Rome (IT)

( * ) Notice: Subject to any disclaimer, the term of this patent is extended or adjusted under 35 U.S.C. 154(b) by 28 days.

(21) Appl. No.: 15/754,816

(22) PCT Filed: Aug. 29, 2016

(86) PCT No.: PCT/IT2016/000200
§ 371 (c)(1),
(2) Date: Feb. 23, 2018

(87) PCT Pub. No.: WO2017/037749
PCT Pub. Date: Mar. 9, 2017

(65) Prior Publication Data

US 2019/0118906 A1 Apr. 25, 2019

(30) Foreign Application Priority Data

Sep. 1, 2015 (IT) ..... 10201500047582

(51) Int. Cl.
*B63B 5/20* (2006.01)
*B63B 9/06* (2006.01)
(Continued)

(52) U.S. Cl.
CPC ..... *B63B 9/065* (2013.01); *B63B 5/20* (2013.01); *B63B 21/29* (2013.01); *B63B 35/34* (2013.01);
(Continued)

(58) Field of Classification Search
CPC ..... B63B 9/065; B63B 5/20; B63B 35/34; B63B 35/44; E01D 15/14
See application file for complete search history.

(56) References Cited

U.S. PATENT DOCUMENTS 3,546,773 A * 12/1970 Gerstin ..... E01C 9/08 114/258
3,983,830 A * 10/1976 Morgan ..... B63B 3/08 114/77 R
(Continued)

FOREIGN PATENT DOCUMENTS

FR 2167059 A5 8/1973
FR 2597826 A1 10/1987

OTHER PUBLICATIONS

International Search Report for PCT/IB2016/000200 dated Nov. 18, 2016.

*Primary Examiner* — Stephen P Avila
(74) *Attorney, Agent, or Firm* — Thomas|Horstemeyer LLP

(57) ABSTRACT

The invention has for object a system and a method for the realization of floating platforms formed by the aggregation of floating forms in reinforced concrete, the union set of the modules is made integral forming a single plate inserting and pulling special steel cables that cross the entire platform in sheaths arranged in the walls of the modules themselves, the pulled cables, locked in this position, compress the plate to increase resistance, the present method and system are also characterized by the fact that the quota of the platform does not vary with the tides and the loads to which it is subjected.

9 Claims, 3 Drawing Sheets

Figure 1:
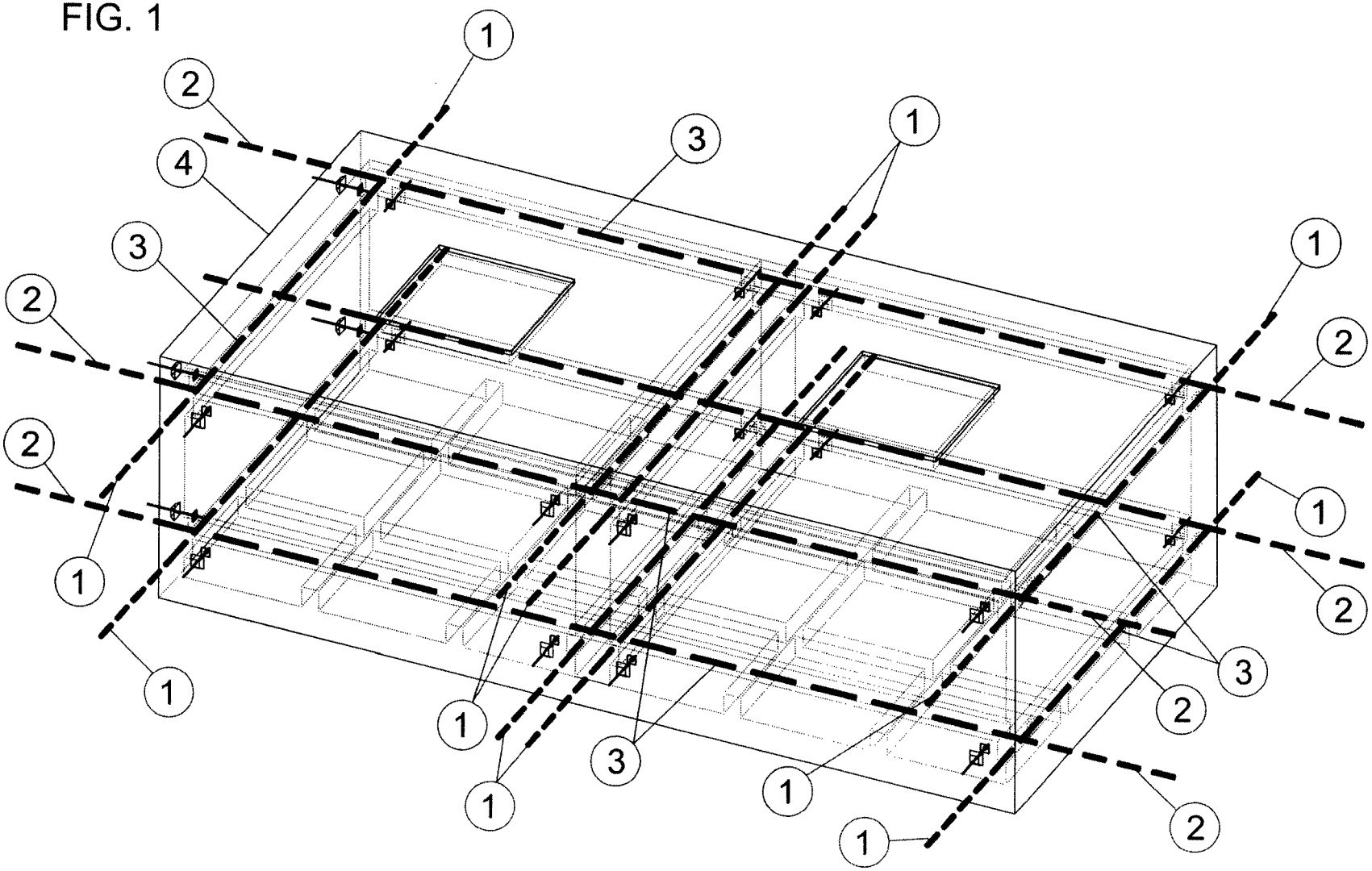

(51) Int. Cl.

| | |
|---|---|
| ***B63B 35/34*** | (2006.01) |
| ***B63B 35/44*** | (2006.01) |
| ***E01D 15/14*** | (2006.01) |
| ***B63B 21/29*** | (2006.01) |
| *B63B 21/50* | (2006.01) |

(52) U.S. Cl.
CPC ..... *B63B 35/44* (2013.01); *E01D 15/14* (2013.01); *B63B 21/50* (2013.01); *B63B 2009/067* (2013.01); *B63B 2221/08* (2013.01); *B63B 2231/64* (2013.01); *B63B 2241/20* (2013.01)

(56) References Cited

U.S. PATENT DOCUMENTS

| | | | | |
|---|---|---|---|---|
| 4,709,647 | A * | 12/1987 | Rytand | E02B 3/064 114/263 |
| 4,884,918 | A | 12/1989 | Gulbenkian | |
| 5,107,785 | A | 4/1992 | Baxter | |
| 6,199,502 | B1 * | 3/2001 | Mattson | B63B 5/18 114/266 |
| 7,827,642 | B2 * | 11/2010 | Han | E01D 2/02 14/74.5 |
| 7,996,941 | B2 * | 8/2011 | Spinelli | E01D 15/20 14/2.6 |
| 8,087,373 | B2 * | 1/2012 | Mattson | B63B 3/08 114/263 |
| 2005/0103250 | A1 | 5/2005 | Thomson | |

* cited by examiner

SYSTEM AND METHOD FOR THE REALIZATION OF FLOATING PLATFORMS MADE OF POST-COMPRESSED REINFORCED CONCRETE WITH FLOATING QUOTA FIXED AND INVARIABLE

CROSS-REFERENCE TO RELATED APPLICATIONS

This application is the 35 U.S.C. § 371 national stage application of PCT Application No. PCT/IT2016/000200, filed Aug. 29, 2016, entitled "SYSTEM AND METHOD FOR THE REALIZATION OF FLOATING PLATFORMS MADE OF POST-COMPRESSED REINFORCED CONCRETE WITH FLOATING QUOTE FIXED AND INVARIABLE," where the PCT claims priority to and the benefit of, IT Patent Application No. 10201500047582, filed Sep. 1, 2015, both of which are herein incorporated by reference in their entireties.

The present invention has for object a method and a system to realize floating platforms formed by the aggregation of floating forms in reinforced concrete, the union set of the modules is made integral forming a single plate inserting and pulling special steel cables that cross the entire platform in sheaths arranged in the walls of the modules themselves, the pulled cables, locked in this position, compress the plate to increase resistance, the present method and system are also characterized by the fact that the quota of the platform does not vary with the tides and the loads to which it is subjected. Today there is a great need to achieve floating platforms used for many purposes in order to not occupy space on the mainland or to have the surfaces to be used in bodies of water for the most varied activities. At the current state of the art there are modular systems of platforms built with floating modules aggregates between them made in various materials, the limit of these techniques is, however, in dimensions, in fact, without the use of post-compression, using the reinforced concrete modules with only reinforcement, the dimensions of the platform can only increase by increasing the stiffness of the modules with a consequent increase of the relative thicknesses of concrete, there is however a limit beyond which increasing the thickness, the same modules can't float by effect of their excessive weight with respect to the displaced volume of water and then the relative thrust for the floating. The system and the method of this invention overcome these drawbacks by using cables which, inserted in the platform, passing in the walls of the various modules, they are then tensioned and locked, compressing the platform in the parts subjected to greater traction and giving a contrast action in such a solicitation, containing the thickness increases and the weights of the same modules, allowing the realization of reinforced concrete platforms of larger dimension than those made with only the simple reinforcement, while keeping with less thickness the necessary rigidity. With the present invention is also achieved the advantage of realizing stable platforms than the tides and overload, as well as to the effects of excess pressure generated by underwater currents that move below the platform, obtaining at the same time, under the effect of such stresses, the invariability of the platform zones subject to tensile stress or compression, this result is obtained by partially flooding the modules that component the platform, where the post-compressed and tensioned cables are installed, up to sink the platform for a quantity equal to the maximum excursions of the tides added to the amount of sinking which would have under the effect of loads increased of the relative safety loading, subsequently, after the anchor to the seabed, the modules are emptied of water accumulated remaining below the normal water line, in the case they are free from the anchor realized, for a quantity equal to the maximum excursion of the tides summed to the maximum stresses of loads acting on the same platform. The characteristic that the areas of the platform subject to compressive or tensile stresses can't vary their position, allows to optimize the post-compression achieved by the tension of the steel cables compressing only the areas affected by tensile stresses, without having to make the tensioning the cables in areas that are always subject to only compression. Another advantage of the present invention is the speed of the platform assembly.

According to this invention, These and other purposes are achieved by a system for the realization of floating platforms anchored to the seabed so that the portion of the platform does not vary to vary the loads and of the tides, characterized in that it includes a set of modules Plot joined and made integral with each other in post-compressed steel cables; these modules are of parallelepiped shape; the union of these modules is made by joining together the respective half of the longer vertical sides of the parallelepiped that make up the modules; these modules are made of reinforced concrete; inside of said modules there is a reinforced concrete septum placed in the center line of the longer vertical sides of the module; the modules are joined together in the pre-assembly phase by means of threaded steel rods and relative nuts and bolts for tightening of the modules; these modules forming the platform are made integral with each other by means of post-tensioned cables; these post-compression cables of the modules they are inserted in the sheaths located in the lower and upper zones of the vertical walls of the modules and in the upper and lower zones of septums located in the modules; the platform is solidarised forming a single plate by means of the post-compression of the modules obtained by pulling the cables; this post-compression is realized following the two perpendicular directions of lesser and greater vertical sides of the module; these post-tension cables are made integral with the relevant sheaths by the injection of cement mortar between the cable and the sheath; the platform is anchored to the seabed by hooking cables or chains to the ballast, or to the piles driven into the seabed, or to the foundations integral with the seabed; the platform is anchored to the seabed with ropes or chains to the ballast, or to the piles, or to the foundations so as to join the platform stably with the seabed; the whole platform is bound to the seabed and sunk respect to the waterline of a quantity equal to the maximum excursion of the tides added to sinking which would under the effect of the maximum loads agents on the platform.

Such purposes are also achieved by a method for the realization of floating platforms comprising the following steps: a first step characterized by the positioning of weights on the seabed or by the realization of piles or foundations on the seabed for anchoring the platform; a subsequent step in which a first prefabricated floating module made of reinforced concrete, having the shape of a closed parallelepiped with internal septum at one half of the longest side, is joined on the longer side to a second module equal to the first aligning its center line with the beginning of the longest side of the second module, the union takes place through steel bars properly bolted; subsequently, the second step is repeated by adding more modules to obtain a multiple of the final surface of the platform; a further step involves the solidarization of aggregates modules by means of the inserting and the tensioning of the post-compression cables in suitable sheaths positioned in the upper and lower zones of the vertical walls of the modules and of the septum placed in the centerline of the modules, the post-compression cables are inserted and pre-stressed in the perpendicular directions of the vertical walls of the longer and short side of the modules forming the floating platform; in the sheaths containing the post-compressed cables it is injected a special cement mortar to obtain the solidarization of the cables with sheaths; in the next phase the aggregated modules are partially flooded up to sink them partially to a height equal to the maximum excursions of the tides added to the sinking height that they would have with the effect of maximum loads increased the safety load; in a further step, the aggregated modules are connected with cables or chains to the weights, or to the piles, or to the foundations in order to join the aggregation of modules forming the platform with the seabed; at a later stage it is realized a second multiple of the platform joined to the previous one, with the same technique of the previous steps, either by the use of steel rods with related bolts, either by inserting and tensioning of post-compression cables with injection of mortar for the solidarization of cables with the sheaths; for the multiple of platform subsequent to the first, the phase of the anchor to the seabed is carried out subsequently to the step of joining the second multiple of platform at the first; the steps described up to now for the realization and aggregation of multiple of the platform, are repeated up to reach the desired dimensions for the floating platform; a last step is the pumping of the water previously accumulated in the modules.

The characteristics and advantages of the present invention will be apparent from the following description of an embodiment thereof, illustrated by way of non-limiting example in the attached drawings, in which:

The FIG. 1 shows schematically a module according to a first embodiment, the module 6 is made from reinforced concrete with the sheaths 5 prepared for the passage of post-compression cables, they are indicated the threaded bars 4 that serve to provisionally join a module to other modules before it happens the post-compression of the cables, they are drawn the protrusions 3 and the recesses 2 that have negative form identical to the protrusions, such protrusions and recesses serve for centering between the modules that will be aggregated, finally in FIG. 1 are indicated the hatchs 1 for access to the interior of the module 6.

Figure 2:
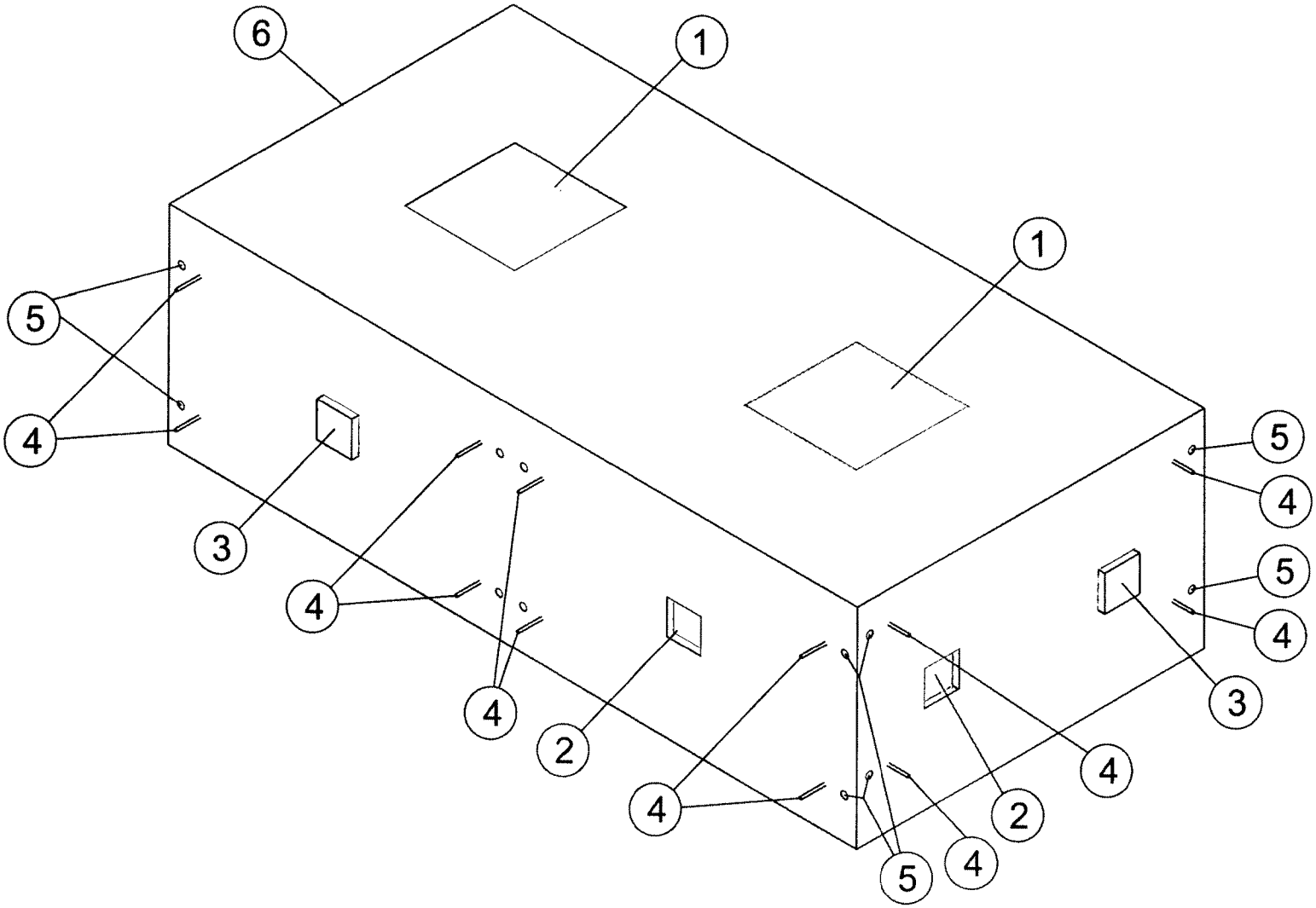

The FIG. 2 shows the module 4 in transparency highlighting the dashed lines 3 with the passages of the sheaths in which there are the cables for the post-compression 1 and 2.

Figure 3:
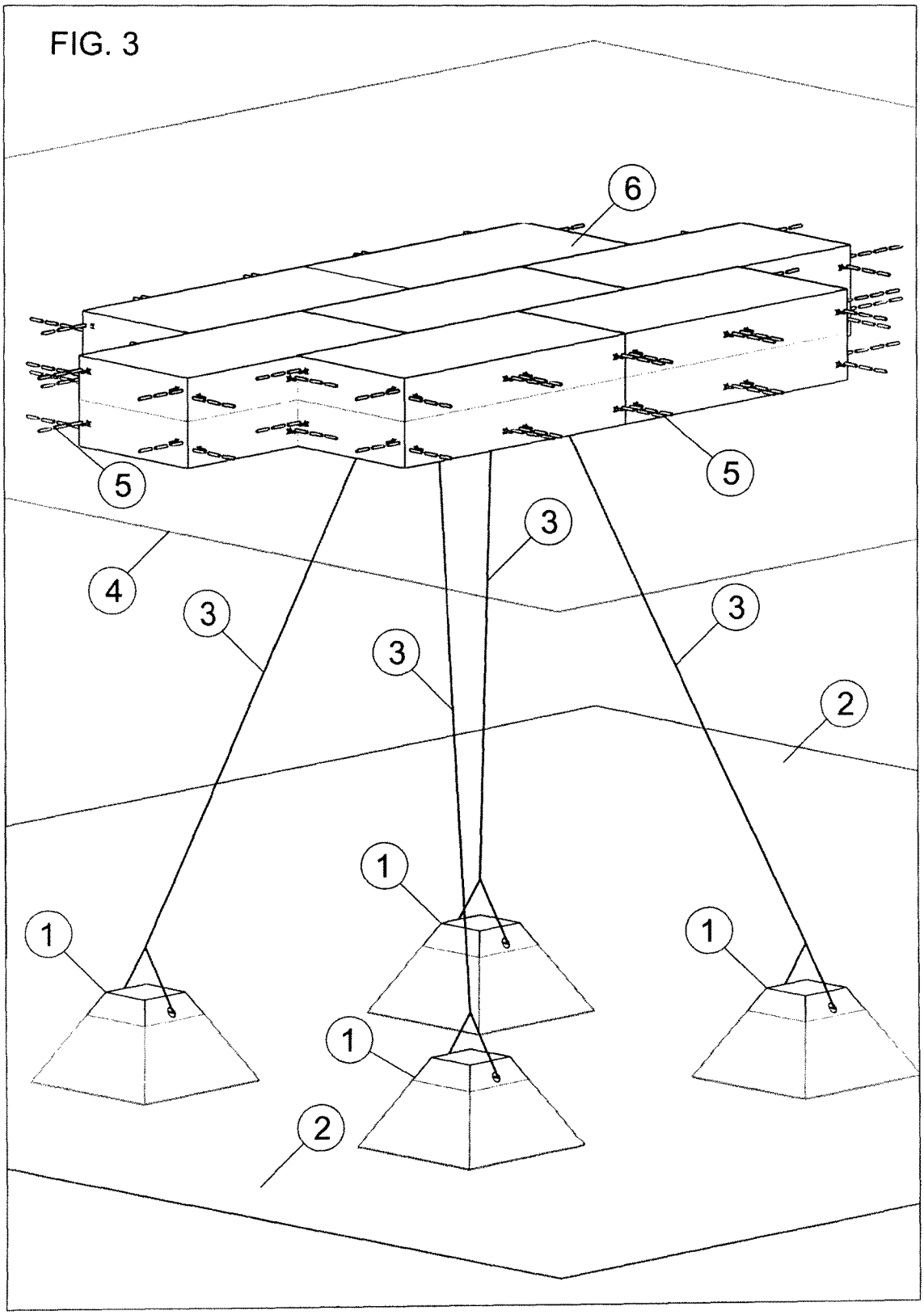

The FIG. 3 shows a schematic aggregation of some modules forming a portion of the platform, inserted in a body of water having surface 4, this portion is anchored to the seabed 2 with the ballast 1 and the connections with steel chains 3, they are also shown in dashed lines the post-tensioned steel cables 5 that continue in the remaining parts of the platform.

The anchoring to the seabed can be realized in various ways, either with the use of weights, both with the use of piles stuck into the seabed, and with other prior art systems. Some of the modules that make up the platform may be increased in height, different from the others in order to satisfy structural requirements and/or of a practical use of the platform. The post-tensioned cables are locked after tensioning with special metal wedges inserted in appropriate housings, the modules where takes place the clamping of the cables are designed with the necessary housings.

The invention claimed is:

1. A system, comprising:

a floating platform, the floating platform comprising:

a plurality of floating modules joined and made integral to each other with steel cables post-compressed and anchored to a seabed in order to obtain invariability of a height of the floating platform and to vary loads acting on the floating platform and an excursion of tides wherein the floating modules are of a parallelepiped shape;

wherein a union of the floating modules is accomplished by stitching together halves of longer vertical sides of parallelepipeds that make up the floating modules, the floating modules being made of reinforced concrete;

wherein inside the floating modules there is a septum made of reinforced concrete placed in a center line of the longer vertical sides of the floating modules;

wherein the floating modules are joined together in a pre-assembly phase by way of steel threaded rods and relative nuts and bolts for the clamping of the floating modules, wherein the floating modules form a floating platform and are made integral with each other by cables post-thesis;

wherein the steel cables of post-compression of the floating modules are housed in sheaths situated in areas below and above vertical walls of the floating modules and in upper and lower zones of the septum located inside the floating modules;

wherein the floating platform solidarized forming a single plate by way of a post-compression of the floating modules obtained by pulling the steel cables, the post-compression being realized by following two directions perpendicular to each other according to the vertical sides minor and major of the floating modules wherein the steel cables are made integral to the sheaths by an injection of cement mortar between the steel cables and the sheaths;

wherein the floating platform is anchored to the seabed and attached to the seabed with ropes or chains, the ropes or chains being coupled to (a) weights anchored into the seabed, (b) stakes anchored into the seabed, or (c) integral foundations positioned in the seabed;

wherein an entirety of the floating platform is constrained to the seabed and sunk with respect to a normal line of flotation of a quantity equal to a maximum excursion of the tides added to sinking which would under an effect of maximum loads acting on the floating platform.

2. The system of claim 1, wherein the floating platform comprises reinforced concrete, the reinforced concrete being reinforced with steel armor and even with post-compressed cable positioned in upper and lower zones of the vertical walls of the floating modules and in a central partition of the floating modules in perpendicular directions.

3. The system of claim 1, wherein the floating platform is anchored to the seabed using weights or piles on the seabed and chains or cables for connection between the floating platform and the seabed.

4. The system of claim 1, wherein at least one of the floating modules has different geometric dimensions from another one of the floating modules to satisfy a structural requirement of the floating platform.

5. The system of claim 1, wherein at least a portion of the floating modules are inserted slots to run the tensioning and locking of the steel cables of post-compression.

6. The system of claim 1, wherein the floating modules are without a central septum in less stressed areas of the floating platform.

7. A method for forming a floating platform, comprising:

(a) positioning weights, piles, or foundations on the seabed for anchoring the floating platform;

(b) merging a longer side of a first floating module with a second floating module to form the floating platform by (i) aligning a center line of the first floating module with an end of the second floating module, and (ii) bolting steel bars to the first floating module and the second floating module, wherein the first floating module and the second floating module are made of reinforced concrete and have a shape of a parallelepiped, the first floating module and the second floating module having an internal septum at a center line of a longest side of a respective one of the first floating module or the second floating module;

(c) reinforcing the floating modules by inserting and pulling post-tensioning cables in sheaths positioned in lower and upper zones of vertical walls of the floating modules and of the internal septum at the center line of the floating modules, the post-compression cables being inserted into and prestressed in a direction perpendicular to the vertical walls of a long and short side of the floating modules, thereby forming the floating platform;

(d) in the sheaths containing the post-tensioning cables, injecting a cement mortar between the post-tensioning cables and the sheaths to obtain a solidarization of both the post-tensioning cables and the sheaths;

(e) partially flooding the floating modules to sink the floating module partially up to a height equal to a maximum tidal excursion added to a sinking height that the floating platforms would experience during maximum loads operating on the floating platform;

(f) connecting the first floating module and the second floating module to the seabed via cables or chains with the weights, piles, or foundations positioned on the seabed to join the floating platform with the seabed;

(g) performing steps (a) through (f) with at least one additional floating module until reaching desired dimensions for a final form of the floating platform; and (h) emptying of the caissons of at least the first floating module and the second floating module by pumping water previously accumulated in the caissons.

8. The method of claim 7, wherein the first floating module and the second floating module, before step (c) is performed, are aggregated with each other using steel threaded rods, nuts and bolts, and anchoring plates.

9. The method of claim 7, wherein step (f) is performed progressively in proportion to an increase of a surface made partially of the floating platform.

* * * * *